United States Patent [19]

Wolfgang

[11] 4,302,952

[45] Dec. 1, 1981

[54] JACQUARD MECHANISM FOR KNITTING MACHINES

[75] Inventor: Rose Wolfgang, Karl Marx Stadt, German Democratic Rep.

[73] Assignee: VEB Kombinat Textima, Karl Marx Stadt, German Democratic Rep.

[21] Appl. No.: 94,868

[22] Filed: Nov. 15, 1979

[30] Foreign Application Priority Data

Nov. 29, 1978 [DD] German Democratic Rep. ... 209380

[51] Int. Cl.[3] ..... D04B 7/00

[52] U.S. Cl. ..... 66/75.2; 66/219

[58] Field of Search ..... 66/75.2, 216, 218, 219, 66/231, 232

[56] References Cited

U.S. PATENT DOCUMENTS

| | | | |
|---|---|---|---|
| 3,695,060 | 10/1972 | Flad | 66/75.2 |
| 3,885,405 | 5/1975 | Manfred | 66/75.2 |
| 3,899,899 | 8/1975 | Bartezs | 66/75.2 |
| 3,974,664 | 8/1976 | Erb | 66/75.2 |

FOREIGN PATENT DOCUMENTS

| | | | |
|---|---|---|---|
| 48-28383 | 2/1973 | Japan | 66/75.1 |

*Primary Examiner*—Ronald Feldbaum
*Attorney, Agent, or Firm*—Michael J. Striker

[57] ABSTRACT

An electromagnetically controlled jacquard mechanism is comprised of a row of interchangeable magnet-unit modules slid onto a shared mounting rod, each magnet-unit module comprising a permanent magnet, an electromagnetic winding and a pole shoe structure. Associated with each magnet unit is a respective jack displaceable between a first and a second position and urged towards second position by a respective biasing spring. When in first position, each jack engages, at a flat holding surface thereon, a flat holding surface on the pole shoe structure of the respective magnet unit, in flat surface-to-surface contact therewith, to maximize the holding force achieved with a given permanent magnet. When the respective coil is briefly energized the resultant flux opposes that of the associated permanent magnet, and the associated jack is pulled by its biasing spring to second position. To facilitate the aforementioned flat surface-to-surface contact, the pole shoe structure of each magnet unit is discrete from the remainder of the magnet unit and somewhat rotatable about the mounting rod and somewhat shiftable in a respective plane normal to the longitudinal direction of the mounting rod, e.g., so that when a respective jack is moved into engagement with the holding structure the pole shoe structure will assume an adjusted position in which flat surface-to-surfce engagement between it and the respective jack is achieved.

12 Claims, 2 Drawing Figures

JACQUARD MECHANISM FOR KNITTING MACHINES

BACKGROUND OF THE INVENTION

The present invention concerns jacquard mechanisms for knitting machines, of the type comprising a set of jacquard-mechanism jacks whose positions are determined by a pattern-data storage, with the jacquard-mechanism jacks controlling needle operation through the intermediary of a pattern wheel or else operating directly on the butts, jacks or pattern bolts of individual needles.

Federal Republic of Germany patent DE-PS No. 1,044,337 discloses a jacquard mechanism in which the positions of the jacquard-mechanism jacks are determined by a jacquard card, with the jacquard-mechanism jacks in turn establishing the positions of jacks of a pattern wheel. Because the mechanism is entirely mechanical in operation and relies upon the use of jacquard cards, considerable limits are placed upon the speed of operation of knitting machines controlled by such jacquard mechanism.

Accordingly, Federal Republic of Germany published patent application DE-OS No. 1,585,078 proposed the selection of the positions of the jacquard-mechanism jacks by electromagnetic means. This jacquard mechanism is provided with a set of angled levers pivotable about a shaft with each lever provided with a respective electromagnet. After the desired angled levers have been moved to selected position, the entire jacquard mechanism is moved as a unit into engagement with the butts to be controlled. This mechanism requires electromagnets capable of developing rather sizable magnetic attractive forces, and therefore considerable amounts of energizing current, which are required to move the angled levers from one to another position against the force of associated biasing springs. Especially where high fabric finenesses and small interneedle spacings are involved, it becomes difficult to provide electromagnets of sufficiently great attractive power in the very limited space available for each one. Furthermore, because the jacquard mechanism must be shifted as a whole into engagement with the butts to be controlled after the angled levers have been set to their selected positions, considerable limits are, here likewise, placed upon the speed of operation of the knitting machine controlled by such system.

Finally, Swiss patent CH-PS No. 517,855 discloses a mechanism in which each knitting needle is provided with a separate magnetic actuator unit of its own, comprised of a detector, a level detector circuit, a monostable circuit, a permanent magnet and a flux-reversing winding operative for reversing the permanent magnet's flux in dependence upon the output pulse produced by the respective monostable circuit. The selection of individual knitting needles is performed via a patterning rocker mounted in the needle bed and activatable by the armature of the respective permanent magnet.

Selected permanent magnets are caused to undergo a direction-reversal of their magnetic flux which releases their armatures for needle-selecting action. The armatures of the non-selected permanent magnets are then pulled back. This system has the clear disadvantage that it requires a considerable number of electronic components for each individual knitting needle, and therefore is very costly to manufacture and assemble. The large number of components needed furthermore increases the system's susceptibility to malfunction and thus involves high maintenance costs. Furthermore, the replacement of individual, malfunctioning components is complicated and requires skilled personnel. Above all, the construction of such system does not provide for or lend itself to quick-assembly modular configuration such as could permit quick assembly of modular components for differing finenesses of fabric to be produced on a cooperating knitting machine.

SUMMARY OF THE INVENTION

It is a general object of the invention to provide an electromagnetically controlled jacquard mechanism which is very reliable in operation, of simple construction, and very easy to service and maintain.

Also, it is an object of the invention to provide an electromagnetically controlled jacquard mechanism whose components perform needle, jack or butt selection motions, as the case may be, of very short duration, so as not to impose limits upon the speed of operation of a cooperating knitting machine.

It is a further object of the invention to provide an electromagnetically controlled jacquard mechanism whose electromagnetic windings need be energized for only brief intervals in a pulsewise manner with energizing current of relatively low magnitude.

It is a further, and also a primary object of the invention to provide an electromagnetically controlled jacquard mechanism consisting of simple, easily assembled and interchangeable modular elements assemblable into various configurations as needed for particular knitting machines or varying set-ups of one associated knitting machine.

In accordance with the presently preferred embodiment of the invention, the electromagnetically controlled jacquard mechanism is made up of a set of interchangeable magnet units, each magnet unit including a permanent magnet, an electromagnetic coil and a pole shoe structure, the interchangeable magnet units being slid into place on a mounting bar, in the manner of pearls threaded onto a string, and held in place on the mounting bar by suitable mounting means such as a plurality of axially extending holding bars. The jacquard mechanism is provided with a row of jacks each associated with a respective magnet unit, the jacks preferably having a bifurcated portion defining an intermediate open recess on which is received a mounting bar shared by all jacks and relative to which the jacks are individually pivotable. The jacks can be displaced to a first setting in which magnetically attractable holding surface portions on the jacks are in surface-to-surface contact with the holding surface portions of the pole shoe structures of the respective magnet units. When the coil of the magnet unit associated with a particular jack is briefly energized, the coil's magnetic field opposes that of the respective magnet unit, with the result that the associated jack is moved by a biasing spring from the first setting to a second setting.

In this way, the permanent magnets employed need be only as strong as needed to positively hold a jack in first position when the jack has been brought to first position, without needing to be so strong as to be capable of, for example, pulling the associated jack from second position into first position.

According to a preferred concept of the invention, the holding surface portions of a jack and its associated pole shoe structure are both flat and engage each other in completely flat surface-to-surface contact to maximize the magnetic holding action which a given, and preferably low, magnetic flux can produce. In order to be able to assure such flat surface-to-surface contact it is presently preferred that the pole shoe structure of each magnet unit be discrete from the respective magnet unit and somewhat shiftable and rotatable about the magnet-unit mounting bar, in order to facilitate adjustment of the orientation of each pole shoe structure individually to match that of the holding surface portion of the associated jack, and that furthermore the biasing spring provided for each jack have an individually adjustable biasing force.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The illustrated jacquard mechanism comprises a housing 1 which, in the concrete example here presented, accommodates two rows of jacquard jacks 4 and 4'. Numeral 2 denotes a pattern-data storage operative for issuing pattern data determinative of the positions of the jacks 4, 4'. The pattern-data storage 2 may be a perforated tape with cooperating perforation reader, a magnetic tape, an electronic data storage or the like; such data storages will be familiar to persons skilled in the art.

Figure 1:
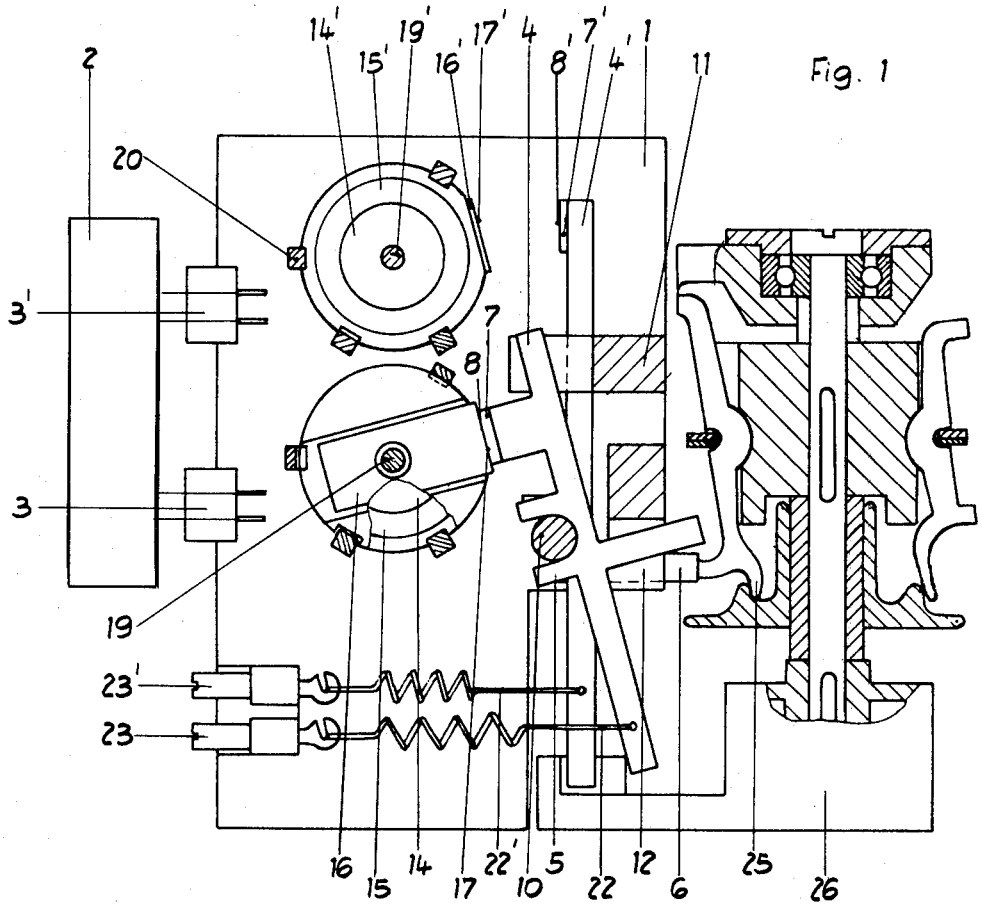
FIG. 1 is a section taken through one embodiment of the inventive electromagnetically controlled jacquard mechanism and through the pattern wheel of a cooperating knitting machine.

The jacks 4, 4' are each formed with two prongs defining an intermediate guide recess 5, at which the respective jack is pivotally mounted on a mounting shaft 10 shared by all the jacks 4, 4'. The jacks 4, 4' are supported and guided within the slots of a jack bed 11, 12 constituted by standardized elements 11 and standardized elements 12 which are stacked together to form the jack bed. Each jack 4 or 4' has a butt 6 for selecting pattern jacks 25 of a pattern wheel, as shown. Each jack 4 and 4' is additionally provided, at its other side, with a projection 7 or 7' provided with a ferromagnetic element 8 or 8'. As shown more clearly in FIG. 2, the ferromagnetic element 8 or 8', hereafter referred to as a holding surface portion, has the configuration of a simple flat plate. In FIG. 1, jack 4' is shown in operative or selecting position, whereas jack 4 is shown in inoperative or non-selecting position. The jacks 4, 4' are urged towards operative or selecting position by respective tension springs 22 and 22', one per jack. Each tension spring 22 or 22' is provided with a respective adjustment screw 23 or 23' for manual adjustment of the biasing force which the respective tension spring applies to the respective jack.

Figure 2:
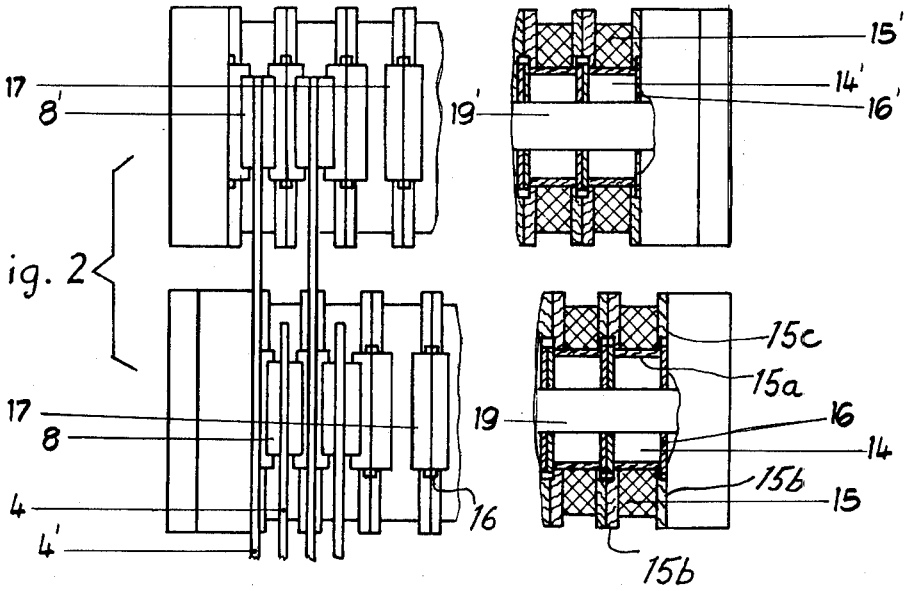
FIG. 2 is a front view of the jacquard mechanism of FIG. 1, partly in section.

The housing 1 furthermore mounts two mounting shafts 19, 19', upon each of which is mounted a respective series of magnet units. Each magnet unit comprises an annular permanent magnet 14, a respective coil 15, a sleeve member **15*a* interposed between coil 15 and permanent magnet 14, and a respective pair of side plates 15*b* between which the respective coil 15 is axially confined. Each magnet unit 14, 15, 15*a*, 15*b* is slid onto mounting bar 19, in the manner of beads strung onto a string. The magnet units are all the same and interchangeable. As shown in FIG. 2, the outer faces of the two side plates 15*b* of each magnet unit are each provided with a recess 15*c*. Each recess 15*c* accommodates a respective pole shoe element 16. As shown at 16 in FIG. 1, pole shoe element 16 has basically the form of a flat rectangular plate, but its end is provided with a holding surface portion 17. As shown in FIG. 2, the thickness of holding surface portion 17, measured in the axial direction of mounting shaft 19, is greater than the axial thickness of the main part of pole shoe element 16**.

As shown for jack 4 of FIG. 1, the jack's flat holding surface portion 8 can be brought into flat, surface-to-surface engagement with the flat holding surface portion 17 of a respective pole shoe element 16. In order to assure that flat, surface-to-surface engagement between holding surface portions 8 and 17 is established, each pole shoe element 16 has a central opening, by means of which it is slid in its turn onto the mounting shaft 19, larger in diameter than the mounting shaft 19. Likewise, the recess **15*c* in which each pole shoe element 16 is accommodated is somewhat larger than the pole shoe element 16 itself, i.e., as shown in FIG. 1. Accordingly, each pole shoe element 16 can be slightly rotated with respect to mounting shaft 19, and also shifted within its own general plane, so that it can be brought into a position in which the holding surface portions 8 and 17** will come into exactly flat surface engagement with each other.

On mounting rod 19, there are two individual pole shoe elements 16 between each two magnet units **14, 15, 15*a*, 15*b*. As shown most clearly in FIG. 2, the holding surface portion 8 of each jack 4 engages the holding surface portions 17 of the two pole shoe elements 16 at either axial end of the respective magnet unit 14, 15, 15*a*, 15*b*. The magnet units and pole shoe elements are pushed into place on mounting rod 9** individually, i.e., one magnet unit, then two pole shoe elements, then the next magnet unit, then the next two pole shoe elements, etc.

The magnet units are held in place by a plurality of bars 20. Some of the bars are received in peripheral indentations of the side plates **15*b*, for preventing rotation of the magnet units relative to mounting shaft 19, whereas others of the bars are provided with recesses each of which fits over and receives the marginal portions of two adjoining side plates 15*b*** in order to properly position the magnet units.

For maximum interchangeability of parts and for the sake of interchangeable-module modular construction of such jacquard mechanisms, the jacquard mechanism is preferably provided with two or more mounting bars 19, 19', for mounting two or more rows of magnet units, i.e., as shown in the drawings. The magnet units and pole shoe elements of all rows, i.e., if more than one row is actually to be used, are all identical. However, and as shown in FIG. 1, the number of different jack configurations 4, 4' employed will in general need to be at least equal to the number of magnet-unit rows employed, and as shown in FIG. 2, the magnet-unit rows are offset relative to each other, so that the butts of the respective rows of jacks 4 and 4' alternate uniformly. Accordingly, one and the same housing can be used for different gauges of fabric, for example using only a single magnet-unit row for fabric of one fineness, two magnet-unit rows when the cooperating knitting machine is set up for fabric of twice that fineness, and so forth.

Each individual coil 15 or 15' is connected to a respective output of pattern-data storage 2 via a respective plug-and-socket connector located in one of two connector rows 3 and 3'.

The jacquard mechanism operates as follows:

Initially, all jacks 4 and 4' are in starting position, with their holding surface portions 8 or 8' in surface-to-surface contact with the holding surface portions 17 or 17' of the two pole shoe elements 16 or 16' of their respective magnet units. The force of attraction exerted by each permanent magnet 14 on the holding surface portion 8 of the associated jack 4 is sufficiently great to firmly hold portion 8 against the associated pole shoe element's holding surface portion 17 if the two surface portions 8, 17 are first brought into physical contact with each other or at least into fairly close proximity, but the magnet's force of attraction is not so great as to be able to pull the jack 4 to it if the jack is in operative or selecting position (the position shown for jack 4' in FIG. 1); accordingly, the permanent magnets 14 employed need not be of great strength.

When the jacks 4, 4' are to be programmed, the pattern-data storage 2 applies brief current pulses to the coils 15 of those jacks which are to be selected. If a particular coil 15 is energized, the magnetic flux which it produces opposes and cancels or reduces the magnetic flux emanating from the associated permanent magnet 14, as a result of which the associated jack 4 or 4' is now subjected to insufficient magnetic holding force and pulled to operative or selecting position by its associated tension spring 23 or 23'.

After the jacks 4, 4' have been thusly programmed, they are capable of implementing a programmed pattern. In FIG. 1, by way of example, the jacks 4, 4' are used to establish the settings of the patterning jacks 25 of a pattern wheel mounted for translation (in direction perpendicular to the plane of the drawing) along the length of a (non-illustrated) bed of knitting needles; such action will be familiar to persons skilled in the art. As the pattern wheel rotates along the rows of jacks 4 and 4', successive one of its patterning jacks 25 are displaced by selected ones of the jacks 4 and 4'. In turn, and as familiar to those skilled in the art, the pattern wheel with its jacks 25 will then roll along the needle bed of the cooperating knitting machine and operate upon the needles' own jacks or butts to control the operation of the needles, e.g., by displacing such needles out of the range of operativeness of a travelling cam slide, or the like, in conventional manner.

After the patterning data has been transferred to the pattern wheel, those jacks 4, 4' which are not presently in starting position (the position shown for jack 4' in FIG. 1) are returned to starting position by a cam 26. Cam 26 may be a cam on the travelling cam carriage of the cooperating knitting machine, or may be a cam mounted for travel along with the pattern wheel. The jacks 4, 4' are now ready for the next programming operation. Instead of the jacks 4, 4' being thusly returned to starting position just after the pattern wheel passes by them, the cam 26 could, of course, be located to return the jacks to starting position just before the pattern wheel reaches the jacquard mechanism. Other such modifications will be apparent to those skilled in the art. Persons skilled in the art will understand that the needle bed of the cooperating knitting machine will be located to the right of the pattern wheel in FIG. 1, and run parallel to the rows of jacks 4, 4'.

Instead of the jacquard arrangement being located in front of such needle bed in that way, alternatively the jacquard arrangement could of course be located lower than the needle bed and have a length corresponding to the full length of the needle bed, for control of knitting needles without the intermediary of a pattern wheel. In that case there would be one jack 4 or 4' for each needle, and the butt 6 of the jack 4 or 4' would act directly upon the jack, butt, control bolt, or whatever, of the associated needle. In that event, i.e., because the rows of jacks 4, 4' would then become much lengthier, it would be preferred that the housing 1 be subdivided into a plurality of successive housings.

It will be understood that each of the elements described above, or two or more together, may also find a useful application in other types of constructions differing from the types described above.

While the invention has been illustrated and described as embodied in the context of a particular mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A jacquard mechanism comprising, in combination, a row of jacks and means mounting the jacks for movement between a first position and a second position, a row of magnet units, one for each jack, each magnet unit comprising a permanent magnet, a pole shoe structure, and a coil, the permanent magnet being operative for holding the respective jack in first position against the respective pole shoe structure, the coil when energized with current of a predetermined polarity generating a field opposing the holding force exerted upon the jack by the permanent magnet, a mounting bar, the row of magnet units being all identical and thereby interchangeable and being removably mounted on the mounting bar, biasing means operative for urging the jacks towards the second position thereof, and control means operative for energizing the coils of selected magnet units with current of the predetermined polarity.

2. A jacquard mechanism as defined in claim 1, the magnet units being of generally annular configuration and having central openings surrounding the mounting bar, whereby during assembly of the magnet units on the mounting bar the magnet units can be pushed one by one onto the mounting bar to form the row of magnet units.

3. A jacquard mechanism as defined in claim 2, the mounting bar being of circular cross-section, furthermore including means for holding the magnet units in place on the mounting bar to prevent rotation of the magnet units about the mounting bar.

4. A jacquard mechanism as defined in claim 3, the holding means comprising bars extending along the row of magnet units, the bars being provided with a row of holding portions which engage successive ones of the magnet units of the row of magnet units.

5. A jacquard mechanism as defined in claim 1, the jacks each having an open recess, the mounting means for the jacks including a jack mounting rod extending through the open recesses of the jacks and mounting the jacks for tilting movement between the first and second positions thereof, each jack having a butt for transmitting pattern data to a component of a knitting machine controlled by the jacquard mechanism, each jack furthermore having a holding surface portion of magnetically attractable material which engages the pole shoe structure of a respective magnet unit when the jack is in the first position.

6. A jacquard mechanism as defined in claim 1, the row of jacks, the row of magnet units, the mounting bar and the biasing means being a first row of jacks, a first row of magnet units, a first mounting bar and first biasing means, furthermore including at least one further row of jacks, at least one further row of magnet units, at least one further mounting bar for the further row of magnet units and further biasing means acting on the further row of jacks, the jacks of each row being of a different respective configuration, the magnet units of each row of magnet units being differently offset from each other as considered in the direction in which the mounting bars extend.

7. A jacquard arrangement as defined in claim 1, the coils of the magnet units being connected to the control means by plug and socket connectors.

8. A jacquard mechanism as defined in claim 1, furthermore including adjusting means for adjusting the biasing force provided by the biasing means.

9. A jacquard mechanism as defined in claim 1, furthermore including a travelling component which travels along the needle bed of a knitting machine, the travelling component being provided with a cam operative for successively displacing all jacks which are in the second position to the first position thereof.

10. A jacquard mechanism as defined in claim 1, the pole shoe structure of each magnet unit being flat, each jack being provided with a flat magnetically attractable holding surface portion which is in flat surface-to-surface engagement with the pole shoe structure of the respective magnet unit when the jack is in first position, the pole shoe structures each being mounted displaceably on the mounting bar whereby to facilitate adjustment of the positions of the pole shoe structures such as to assure such flat surface-to-surface engagement.

11. A jacquard mechanism as defined in claim 1, furthermore including a knitting machine having a needle bed, the row of magnet units and the row of jacks extending over the whole length of the needle bed, the jacks being each operative for controlling a respective one of the needles of the needle bed.

12. A jacquard mechanism as defined in claim 1, furthermore including a pattern wheel provided with pattern-wheel jacks, the pattern wheel travelling along the row of jacks of the jacquard mechanism with the pattern-wheel jacks being programmed by the jacks of the jacquard mechanism.

* * * * *